United States Patent [19]

Ueno et al.

[11] Patent Number: 4,671,683

[45] Date of Patent: Jun. 9, 1987

[54] PRINTER WHICH DETERMINES WHETHER THE TEXT IN MEMORY CAN FIT ON A SHEET OF PAPER

[75] Inventors: Hideo Ueno, Nagoya; Hiroshi Kuno, Inazawa; Yoshifumi Hamabe, Chiryu, all of Japan

[73] Assignee: Brother Industries, Ltd., Nagoya, Japan

[21] Appl. No.: 669,267

[22] Filed: Nov. 7, 1984

[30] Foreign Application Priority Data

Nov. 18, 1983 [JP] Japan ..... 58-215954

[51] Int. Cl.[4] ..... B41J 5/30

[52] U.S. Cl. ..... 400/61; 400/76; 400/670.1; 400/708

[58] Field of Search ..... 400/64, 76, 568, 670, 400/670.1, 706, 705.3, 708, 708.1, 61

[56] References Cited

U.S. PATENT DOCUMENTS

| | | | |
|---|---|---|---|
| 3,631,957 | 1/1972 | Terry | 400/7 |
| 3,895,704 | 7/1975 | Norris | 400/64 |
| 4,497,589 | 2/1985 | Figini | 400/706 |

FOREIGN PATENT DOCUMENTS

| | | | |
|---|---|---|---|
| 2437300 | 5/1980 | France | 400/76 |
| 58-163682 | 9/1983 | Japan | 400/708 |

*Primary Examiner*—Edgar S. Burr
*Assistant Examiner*—David A. Wiecking
*Attorney, Agent, or Firm*—Kane, Dalsimer, Kane, Sullivan and Kurucz

[57] ABSTRACT

An electronic typewriter including a memory storing therein text data which is printed as printing signals are produced. The electronic typewriter enables the operator to pass judgment as to whether printing can be performed on a portion of a sheet of paper between the last printed line and the trailing end of the sheet when the sheet of paper has been set in the typewriter in a usual manner, so that printing can be continued when it is possible to do so. When it is judged that it is impossible to continue printing due to a lack of space, printing is stopped and the existence of the condition of "paper empty" is indicated, prompting the operator to insert a new sheet of paper.

2 Claims, 4 Drawing Figures

PRINTER WHICH DETERMINES WHETHER THE TEXT IN MEMORY CAN FIT ON A SHEET OF PAPER

BACKGROUND OF THE INVENTION (1) Field of the Invention

This invention relates to an electronic typewriter for printing text data stored in a memory system on a sheet of paper when printing signals are produced.

(2) Description of the Prior Art

In known electronic typewriters, many of them are capable of printing information on a printing sheet both directly at the time the keys are actuated and after a predetermined time or an arbitrarily selected time has elapsed after the keys are actuated by storing the information in a memory system of a desired capacity. To this end, electronic typewriters known in the art comprise a memory system built therein which includes a read-only memory (hereinafter ROM) which may be a program memory to which a predetermined program is written or a pattern memory for storing patterns of characters and symbols, and a random-access memory (hereinafter RAM) enabling the information written thereto to be replaced by new one. Thus, the electronic typewriters are capable of performing a variety of functions by virtue of the memory system and a central processing unit (hereinafter CPU) for controlling the memory system.

One of these functions is to prepare a text not only by the operation of the electronic typewriters themselves but also by storing in the memory system those data which are transmitted from similar equipment or other external devices to the electronic typewriters, so that the contents of these texts can be printed on a printing sheet when it is necessary to do so.

Electronic typewriters of the prior art of the above-noted construction have suffered some disadvantages. One of them is that when a text carrying data stored in the memory system differs in size from a printing sheet, the operator would experience difficulties in judging whether the contents of the text could all be printed on a single printing sheet or it might become necessary to replace the printing sheet by a new one while printing is in progress. This has often led to the printed sheets being unacceptable in appearance.

SUMMARY OF THE INVENTION (1) Object of the Invention

This invention has as its object the provision of an electronic typewriter capable, in printing the contents of a text, of feeding a sheet and performing printing while passing judgment as to whether text data can be printed on a single sheet of paper, and controlling the manner in whch the sheet of paper is handled by taking into consideration the form in which the contents of the text are printed on the sheet of paper.

(2) Statement of the Invention

According to the invention, there is provided an electronic typewriter comprising text memory means for storing the printing data, printing means for printing the printing data stored in the text memory responsive to a printing signal, sensing means for sensing an end portion of a sheet of paper to determine whether the condition of "paper empty" exists, stopping means for stopping a printing operation replying to control signal, counter means for counting after producing the "paper empty" signal the number of lines of a text in the text memory means yet to be printed, a memory means for storing the number of lines that can be printed on the sheet of paper after the end portion thereof has been sensed, and a control unit comparing the content of the counter means with the content of the memory means to control the printing operation of the printing means in such a manner that the lines of the text yet to be printed are printed by invalidating the stopping means when the content of the counter means is smaller than the content of the memory means and the printing operation are interrupted by validating the stopping means in opposite conditions.

Additional and other objects, features and advantages of the invention will become apparent from the description set forth hereinafter when considered in conjunction with the accompanying drawings.

Figure 1:
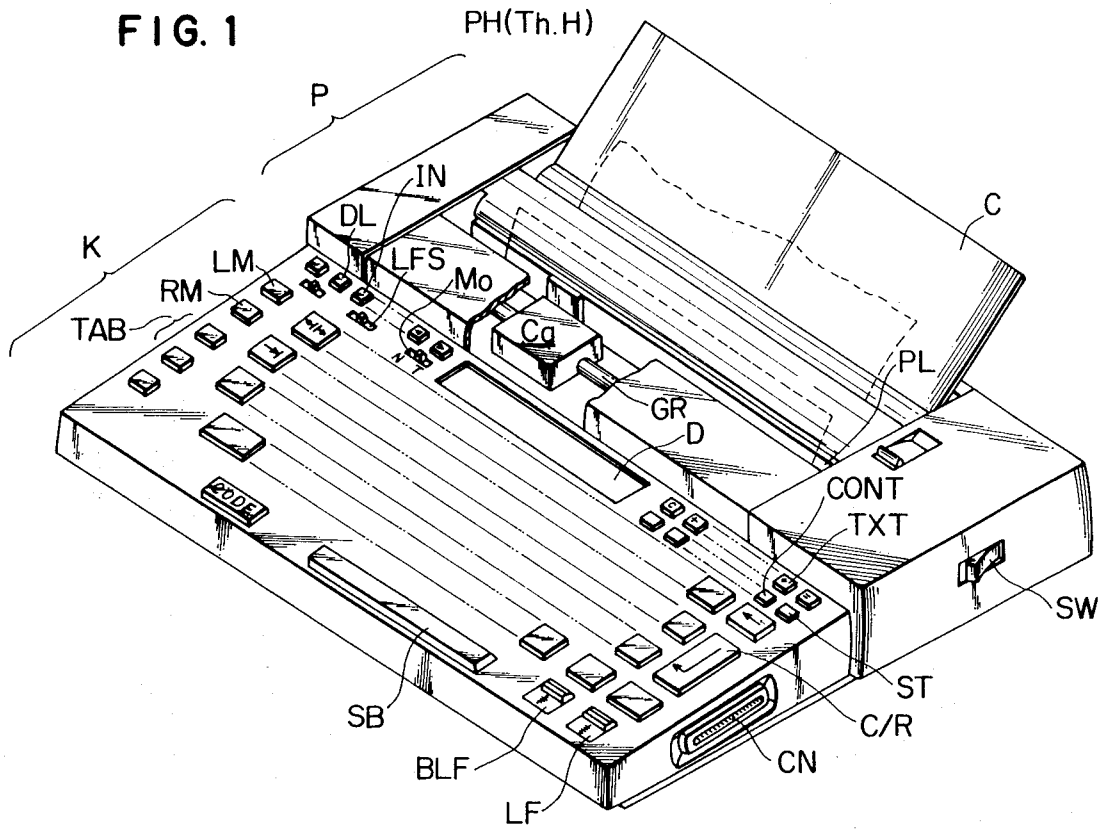
FIG. 1 is a perspective view of an electronic typewriter incorporating therein the present invention, showing its external appearance.

DESCRIPTION OF THE PREFERRED EMBODIMENT:

FIG. 1 schematically shows, in a perspective view, an electronic typewriter incorporating the present invention therein, which comprises a keyboard section K and a printer section P.

The keyboard section K includes various groups of keys usually provided to ordinary typewriters, such as character keys, digit keys and symbol keys of required numbers, a space bar SB and various types of control keys. The control keys include a mode setting key Mo, a stop key ST, a carriage return key C/R, a left margin key LM, a right margin key RM and TAB SET and TAB CLEAR for effecting alterations in setting or releasing the setting. The control keys also include a line feed key LF, a back line feed key BLF, a text printing key TXT, a delete key DL, an insert key IN, a printing continuation key CONT and a line feed amount selection switch LFS. The mode setting key Mo which functions to select a suitable operation mode and set the electronic typewriter to the selected operation mode is capable of switching the electronic typewriter from an ordinary typewriting mode to a text data printing mode and vice versa. The text printing key TXT has the function of causing text data printing to be performed. The printing continuation key CONT is actuated when it is desired to continue a printing operation after it is interrupted. The stop key ST is designed to stop various operations of the typewriter. The line feed amount selection switch LFS has the function of switching the amount of a line to be fed among 1, 1½ and 2, for example, where 1 indicates a condition in which the line is fed $1\times1/6$ inch. The electronic typewriter incorporating the present invention therein has the function of performing arithmetic and logical operations and is provided with a group of keys including a key for switching between typewriting and arithmetic and logical operations, and a clear key as well as keys representing + (plus), − (minus), × (multiplication), ÷ (division) and = (equal).

The keyboard section K further includes a display section D for giving a visual display of the contents of characters, symbols and marks whose keys have been actuated which is located alongside the keyboard section K. Any suitable display unit may be used for giving visual display at the display section D. However, a liquid crystal display unit LCD is advantageously used with the electronic typewriter according to the invention from the point of view of reducing costs by low consumption energy.

In the printer section P, a platen PL, and a carriage Ca movable on a guide rod GR are located inside an upper cover C. Various types of print head PH supported by the carriage Ca may be used. However, a thermal head Th.H is advantageously used because it is compact in size and light in weight, besides being low in energy consumption. The thermal head Th.H has a multiplicity of heat generating elements selectively actuated to generate heat in accordance with input signals in order to perform printing in a dot matrix directly on a sheet of heat sensitive paper or on a sheet of plain paper through a heat-sensitive ribbon.

In the electronic typewriter comprising one enbodiment of the invention, the printer section P comprises a battery serving as a source power. A main switch SW located in a suitable position of a case is operative to turn on and off the battery. By using an AC adapter, the electronic typewriter according to the invention can be run by plugging in an office or household outlet.

Figure 2:
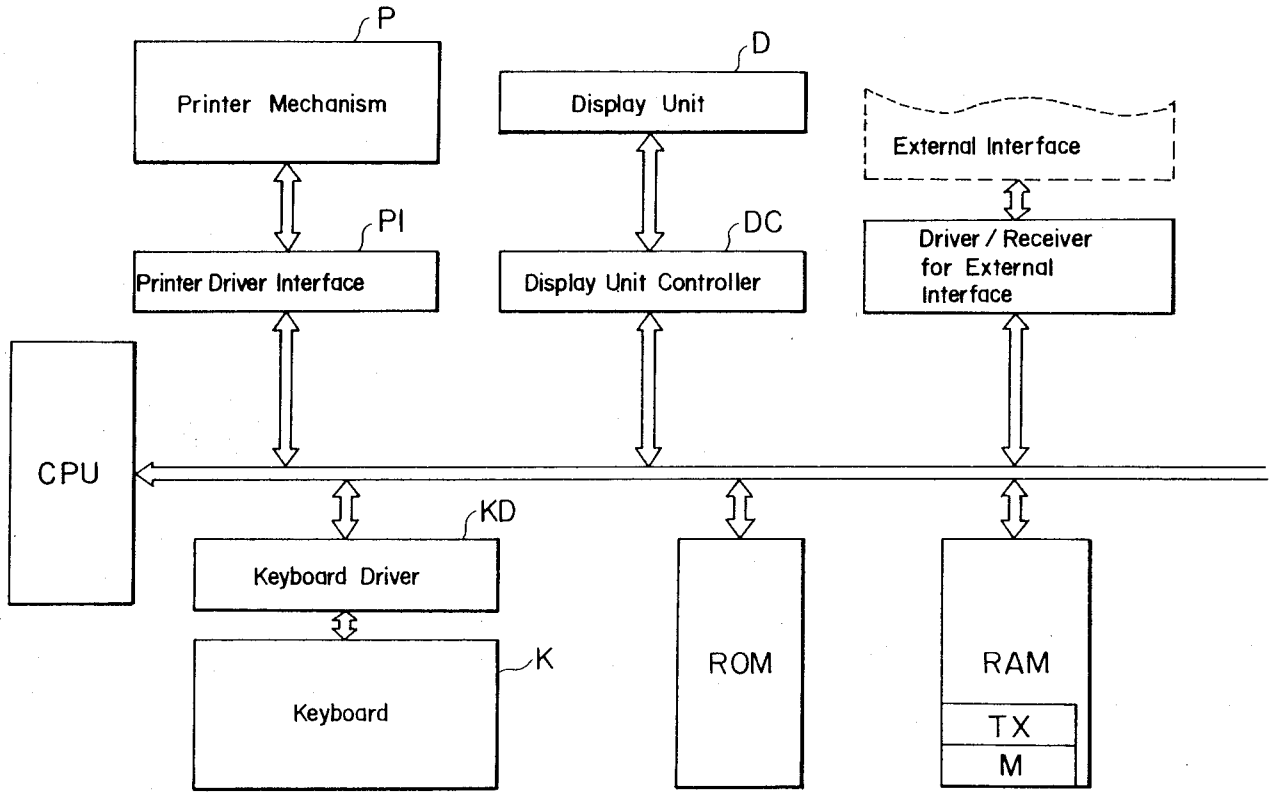
FIG. 2 is a block diagram of the electronic typewriter shown in FIG. 1, showing its inner structure.

FIG. 2 is a block diagram of parts of the electronic typewriter according to the invention, including the keyboard section K, printer section P and display section D shown in FIG. 1 as well as a central processing unit (CPU), ROM and RAM which are contained in the case. The keyboard section K, display section D and printer section P are provided with a keyboard driver KD, display section controller DC and a printer driver interface PI, respectively, which serve as auxiliary circuits. Additionally, the electronic typewriter according to the invention is equipped with an external interface driver/receiver IR enabling exchange of information with outside devices to be performed. Thus, it is possible for the electronic typewriter to transmit information to similar equipment connected through the connector CN located at one side of the typewriter as shown in FIG. 1 or to a computer or other equipment through a suitable interface, and to receive information therefrom for driving the printer section P thereby to perform a necessary printing operation.

Elements constituting the various parts of the block diagram shown in FIG. 2 may be composed of any known elements, such as large-scale integrated circuit or other circuit elements.

Figure 3:
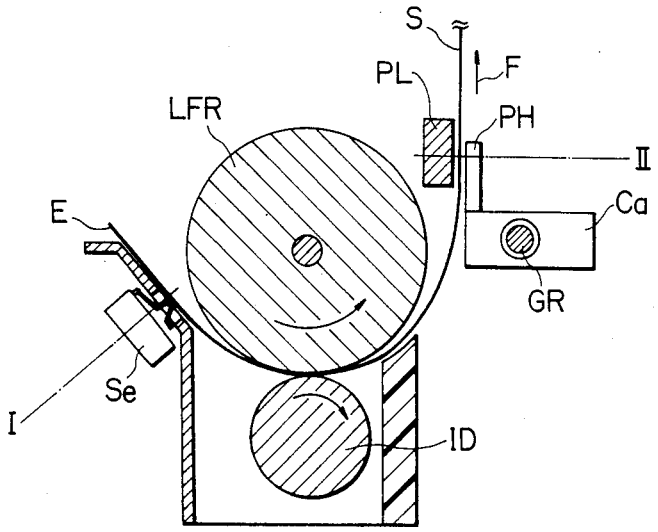
FIG. 3 is a sectional view of the printing means and sensing means.

FIG. 3 is a sectional view of line feed mechanism and printer head of printer section P of the typewriter. The line feed mechanism consists a line feed roller LFR rotated as shown by the arrow-mark and idler ID and feeds the sheet of printing paper as shown by the arrow mark F. When the sheet of printing paper passes on the platen PL, printing operations is done by a printer head PH supported by the carriage Ca which slides on the guide rod GR. The paper end sensing means Se such as a micro-switch or photo electric switch is provided at the rear of the line feed roller LFR and detects end portion E of the sheet of the paper.

The electronic typewriter of the aforesaid construction according to the invention has the function of enabling printing of text data to be performed by taking the condition of a sheet of paper advanced into consideration in other printing modes than an ordinary typewriting mode. This function enables the operator to pass judgment on the prosecution of printing after an end portion of the sheet of paper is sensed during the test data printing operation.

The function makes effective use of the space of the sheet of paper corresponding to the distance between the position I where the end portion of the sheet of paper detecting sensor Se in FIG. 3 is mounted and the position II where the printing head PH effects printing. The distance divided by the amount of line feed based on selection of the line feed selection switch LFS gives the number of lines on which printing may be effected. The number of lines thus obtained is stored in the predetermined location in memory M of RAM.

The confirmation of the number of lines of the text yet to be printed is carried out by counting the carriage return code C/R in the printing data stored in text memory TX. The function of this invention is attainable by comparing the confirmed number of lines yet to be printed with the number of lines corresponding to the space of sheet of paper previously stored in the memory M of RAM.

The printing operation of the printing means is controlled in such a manner that printing is effected on the lines of the text yet to be printed when the confirmed number of lines of text is smaller than the number of lines included in the space of sheet of paper and under opposite conditions, printing is temporarily interrupted.

Figure 4:
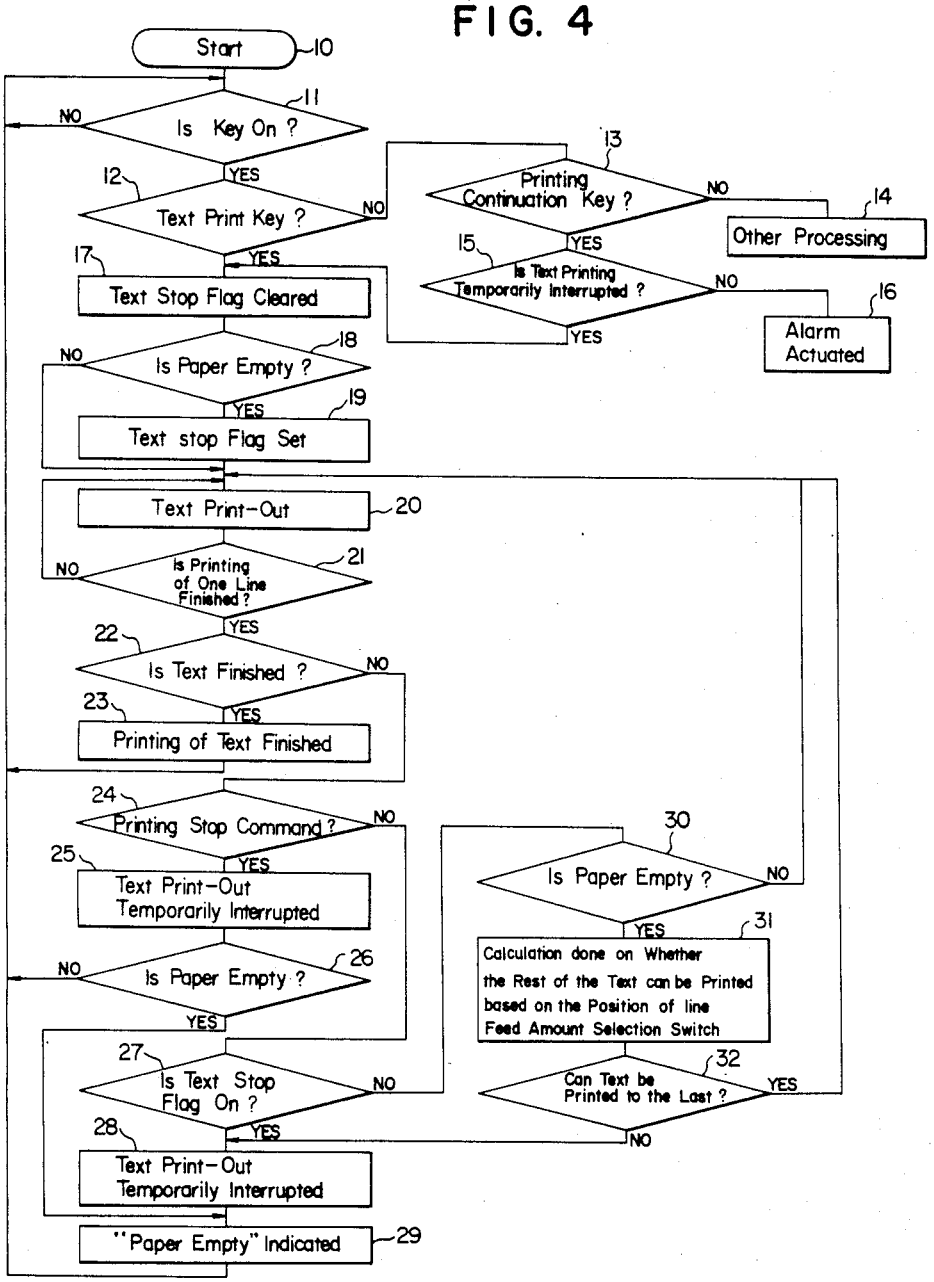
FIG. 4 is a flow chart in explanation of the operation of those parts of the electronic typewriter shown in FIG. 1 which are associated with the present invention.

FIG. 4 is a flow chart showing the operation of the electronic typewriter according to the invention in which the operator can pass judgment with regard to the progress of printing in a text data printing mode.

The operation is started in step 10. In step 11, judgment is passed by means of a key scan as to whether any one of the keys has been actuated. When no keys have been actuated, the judgment is NO and the operation returns to step 10 to start the operation again.

When the judgment passed in step 11 is YES, it is then judged in step 12 whether the actuated key is the text printing key TXT. When the judgment passed is NO, it is judged in step 13 whether the actuated key is the printing continuation key CONT. When the judgment passed is NO, further operation does not require the function of enabling the operator to pass judgment according to the invention, so that the operation is performed by other process as shown in step 14.

When the judgment passed in step 13 is YES, it is then judged in step 15 whether text print-out is temporarily interrupted. When the judgment passed in step 15 is NO, an alarm is produced in step 16 because the actuation of the printing continuation key CONT in step 13 is meaningless. Meanwhile, when the judgment passed in step 15 is YES, the operation returns to step 12 in which the judgment passed is YES.

In step 17, a text stop flag is cleared, when the judgment passed in step 12 is YES or the text printing key TXT has been actuated and when the judgment passed in step 15 is YES or text print-out is temporarily interrupted.

Then, in step 18, it is judged whether the condition of 37 paper empty" exists (i.e. has the far end of the sheet of paper passed the Sensor Se, as shown in FIG. 3). When the judgment passed in step 18 is YES, the text clear flag is set in step 19. Thereafter, in step 20, print-out of the text is performed. Meanwhile, when the judgment passed in step 18 is NO, the operation proceeds to step 20 by bypassing step 19 to enable text print-out to be effected at once.

In step 21, it is judged whether printing of one line has been finished by the print-out performed in step 20. Judgment is passed in step 21 by the carriage return code C/R. When the judgment is NO, the operation returns to step 20 to enable text print-out to be effected. When the judgment is YES, it is judged in step 22 whether printing of text data has been finished. When the judgment passed in step 22 is YES, it is judged. in step 23 that printing of text data has been finished and the termination of printing of the text data is indicated. This brings the printer section P to an inoperative position in which it is ready to start an operation again. The judgment passed in step 22 is based on a comparison of the content of a register storing a final address of the text data provided when the preparation of the text has been finished with an access address.

When the judgment passed in step 22 is NO, it is judged in step 24 whether a printing stop command should be produced. This condition occurs when the text contains a stop code or the stop key ST of the keyboard section K is actuated. When the judgment passed in step 24 is YES, text print-out is temporarily interrupted in step 25. Then, it is judged in step 26 whether the condition of "paper empty" exists. When the judgment is NO, the operation returns to the start.

(When the Judgment Passed in Step 24 is NO)

In this case, it is judged in step 27 whether or not the text stop flag was ON. When the judgment passed is YES, text print-out is temporarily interrupted in step 28, and then indication of the existence of the condition of "paper empty" is given in step 29, thereby returning the operation to the start.

When the judgment passed in step 26 is YES, an indication of the existence of the condition of "paper empty" is given in step 29.

(When the Judgment Passed in Step 27 is NO)

In this case, it is judged in step 30 whether the condition of "paper empty" exists. When the judgment is NO, the operation returns to step 20 to effect text print-out.

When the judgment passed in step 30 is YES, calculation is done in step 31 on whether the rest of the printing data of the text can be printed by taking into consideration the number of lines in the space of sheet of paper based on selection the line feed amount selection switch LFS. Thereafter, in step 32, it is judged whether the text can be printed to the last. If the judgment is YES, then the operation returns to step 20 to perform printing of the text to the last.

If the judgment is NO or the judgment passed indicates that it is impossible to print the text to the last, then the operation returns to step 28 to give indication that the condition of "paper empty" exists while temporarily stopping text print-out. Thereafter, one line of the text is printed each time the printing continuation key CONT is actuated, followed by interruption of printing and indication of the existence of the condition of "paper empty" which repeatedly take place.

From the foregoing description, it will be appreciated that in the electronic typewriter according to the invention, when the text printing key is actuated while the condition of "paper empty" exists, printing of the text data is performed by the operator who judges whether it is possible to effect printing line by line. Thus is conducive to effective utilization of a sheet of paper and provides improvements in the appearance of the printed text which would be acceptable for general use. As a result, the operator is able to print text data economically without wasting time and paper.

What is claimed is:

1. An electronic typewriter comprising:

test memory means for storing lines of printing data;

printing means for printing the printing data stored in the text memory in response to a printing signal;

sensing means for sensing a bottom end portion of a sheet of paper and for generating a "paper empty" signal when such end portion is sensed;

stopping means for stopping a printing operation in response to a control signal;

counter means for counting in response to the "paper empty" signal, the number of lines of printing data in said text memory means yet to be printed;

memory means for storing the number of lines that can possibly be printed on the sheet of paper after the end portion thereof has been sensed; and a control unit comprising means for comparing the content of the counter means with the content of the memory means and means for controlling the printing operation of the printing means in such a manner that the lines of the text yet to be printed are printed by invalidating the stopping means when the content of the counter means is smaller that the content of the memory means and means for generating a control signal to said stopping means for validating said stopping means when the content of the counter means is greater than the content of the memory means.

2. An electronic typewriter comprising;

text memory means for storing lines of printing data, each of said lines ending with a carriage return code;

printing means for printing the printing data stored in the text memory in response to a printing signal;

line feed selection means for selecting the amount of spacing between adjacent lines of printing data;

sensing means for sensing the bottom end portion of a sheet of paper and for generating a "paper empty" signal when such end portion is sensed;

stopping means for stopping a printing operation in response to a control signal;

counter means for counting in response to the "paper empty" signal, the number of lines of printing data in said memory by counting the carriage return codes in the printing data yet to be printed;

memory means for storing the number of lines which may be printed to the end of the sheet of paper, said number being determined by the spacing between adjacent lines; and a control unit comprising means for comparing the content of the counter means and the content of the memory means based on selection of the line feed amount selection switch and means for controlling the printing operation of the printing means in such a manner that the lines of the text yet to be printed are printed by invalidating the stopping means when the content of the counter means is smaller than the content of the memory means and the printing operation is temporarily interrupted by validating the stopping means when the content of the counter means is greater than the content of the memory means.

* * * * *